US009680230B1

(12) United States Patent
Santoru et al.

(10) Patent No.: US 9,680,230 B1
(45) Date of Patent: Jun. 13, 2017

(54) ANTENNA REFLECTOR HYDROPHOBIC COATING AND METHOD FOR APPLYING SAME

(71) Applicant: The DIRECTV Group, Inc., El Segundo, CA (US)

(72) Inventors: Joseph Santoru, Agoura Hills, CA (US); Ernest C. Chen, San Pedro, CA (US); Cecilia C. Comeaux, Redondo Beach, CA (US); Terence Wu, Torrance, CA (US)

(73) Assignee: THE DIRECTV GROUP, INC., El Segundo, CA (US)

( * ) Notice: Subject to any disclaimer, the term of this patent is extended or adjusted under 35 U.S.C. 154(b) by 36 days.

(21) Appl. No.: 14/753,928

(22) Filed: Jun. 29, 2015

(51) Int. Cl.
*H01Q 15/14* (2006.01)
*H01Q 19/10* (2006.01)
*B05D 5/02* (2006.01)

(52) U.S. Cl.
CPC ..... *H01Q 15/141* (2013.01); *B05D 5/02* (2013.01); *H01Q 15/14* (2013.01); *H01Q 19/10* (2013.01)

(58) Field of Classification Search
CPC ..... H01Q 1/36; H01Q 1/225; H01Q 13/02; H01Q 19/13; H01Q 19/139; H01Q 15/14; H01Q 15/141; H01Q 19/10; B05D 5/02
USPC ..... 343/834, 840, 786
See application file for complete search history.

(56) References Cited

U.S. PATENT DOCUMENTS 5,175,562 A * 12/1992 Rappaport ..... H01Q 19/175 343/840
6,495,624 B1 * 12/2002 Brown ..... B01L 3/50 524/462
6,611,238 B1 * 8/2003 Santoru ..... H01Q 13/02 343/786
7,342,551 B2 * 3/2008 King ..... H01Q 19/132 343/786
8,785,556 B2 * 7/2014 Brown ..... C09D 127/18 524/544
2003/0058189 A1 * 3/2003 Crouch ..... H01Q 3/46 343/912
2004/0082699 A1 * 4/2004 Brown ..... B01L 3/00 524/462
2011/0241952 A1 * 10/2011 Grice ..... H01Q 1/42 343/704
2012/0067908 A1 * 3/2012 Brown ..... C09D 127/18 220/660
2015/0276459 A1 * 10/2015 Sai ..... G01F 23/284 73/290 V

* cited by examiner

*Primary Examiner* — Lam T Mai
(74) *Attorney, Agent, or Firm* — Gates & Cooper LLP

(57) ABSTRACT

An improved antenna reflector coating and a method for applying the coating is disclosed. A region of the reflector surface smaller than the entire reflective surface is identified and designated for hydrophobic treatment, and thereafter hydrophobically treated. Provision is made for identifying the region according to desired parameters and in consideration of multiple LNB embodiments.

30 Claims, 12 Drawing Sheets

View from Feed

View from Boresight

Top View

Side View

ANTENNA REFLECTOR HYDROPHOBIC COATING AND METHOD FOR APPLYING SAME

BACKGROUND

1. Technical Field

The present disclosure relates to systems and methods for receiving electromagnetic signals via antennas using reflective elements, and in particular to an improved antenna reflective coating.

2. Description of the Related Art

Satellite distribution of media programs has become commonplace. Initially, such distribution was accomplished with earth-based antennas that were large (>1 meter) and somewhat unsightly. These antennas included reflectors of parabolic cross section, and symmetric about the center axis. Signals from the satellite(s) transmitted via electromagnetic energy reflect off of the surface of the reflector, and are focused at a point along the centerline of the reflector, known as the focus or focal point. An antenna feed was placed at the center axis at the focal point to receive the electromagnetic energy and provide the received energy to a receiver. In this antenna design, the feed is disposed on the centerline of the reflector.

In later years, smaller satellite antennas were developed for receiving media programs. These smaller antennas utilize an offset feed and semi-parabolic shape, and typically operate in different frequency regimes that provide adequate received signal strength. Unfortunately, these designs can be more sensitive to attenuation from water accumulation on the reflector, typically from rain and snow. Many techniques exist to deal with this problem. Some of the techniques provide a systemic solution. For example, the satellite may be commanded to beam greater signal strengths in areas known to include rainfall or to areas having receivers that are measuring reduced signal strength due to weather effects. Other techniques operate on a system element level. For example, coatings have been developed which discourage the accumulation of water, snow and ice on the reflector surface. Unfortunately, such coatings are expensive to apply, reducing their application or increasing costs to customers. What is needed is a technique of providing reductions in rain and snow attenuation for reduced cost. The disclosed system and method satisfies that need.

SUMMARY

To address the requirements described above, the following discloses an improved antenna reflector coating and a method for applying such coating. The antenna reflector is used to receive a signal conveyed by electromagnetic energy, and includes a reflector surface reflecting the electromagnetic energy to a feed. The improved antenna reflector surface can be hydrophobically treated by designating a region of the reflector surface for hydrophobic treatment, the region being less than the surface of the reflector facing a source of the electromagnetic energy; and hydrophobically treating only the region of the reflector surface.

In another embodiment, an antenna for receiving a signal conveyed by electromagnetic energy is disclosed. The antenna comprises a reflector, having a reflective surface for reflecting the electromagnetic energy, and a feed, for receiving the reflected electromagnetic energy. The reflector surface comprises a hydrophobically treated region consisting of less than the surface of the reflector facing a source of the electromagnetic energy, and a hydrophobically untreated surface consisting of a remainder of the surface of the reflector facing the source of the electromagnetic energy.

BRIEF DESCRIPTION OF THE DRAWINGS

Referring now to the drawings in which like reference numbers represent corresponding parts throughout.

DETAILED DESCRIPTION

In the following description, reference is made to the accompanying drawings which form a part hereof, and which is shown, by way of illustration, several embodiments of the based on this disclosure. It is understood that other embodiments may be utilized and structural changes may be made without departing from the scope of this disclosure.

Distribution System

Figure 1:
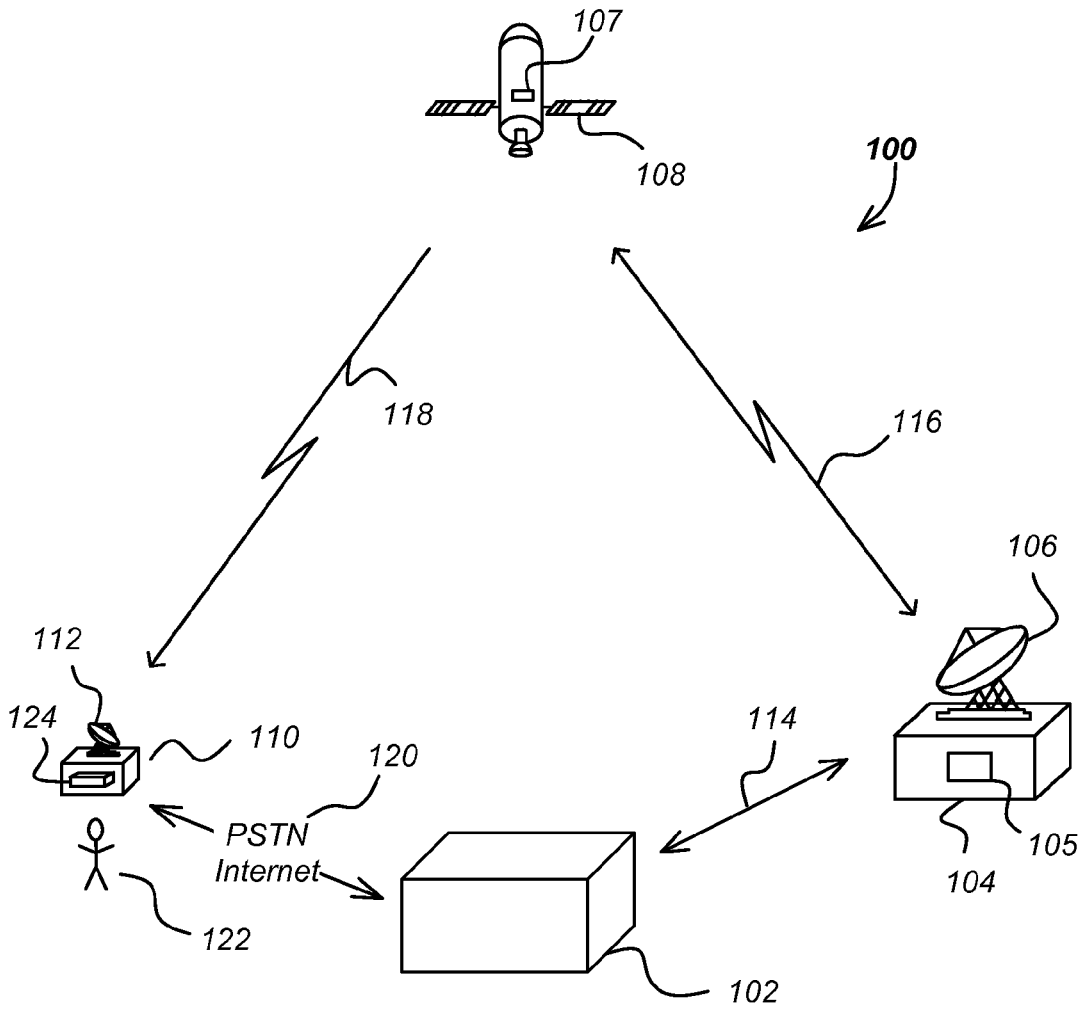
FIG. 1 is a diagram illustrating an overview of a distribution system that an be used to provide video data, software updates, and other data to subscribers.

FIG. 1 is a diagram illustrating an overview of a distribution system 100 that can be used to provide video data, software updates, and other data to subscribers. The distribution system 100 comprises a control center 102 in communication with an uplink center 104 via a ground or other link 114 and with a subscriber receiver station 110 via a public switched telephone network (PSTN) or other link 120. The control center 102 provides program material (e.g. video programs, audio programs, software updates, and other data) to the uplink center 104 and coordinates with the subscriber receiver stations 110 to offer, for example, pay-per-view (PPV) program services, including billing and associated decryption of video programs.

The uplink center receives program material and program control information from the control center 102, and using an uplink antenna 106 and transmitter 105, transmits the program material and program control information to the satellite 108. The satellite receives and processes this information, and transmits the video programs and control information to the subscriber receiver station 110 via downlink 118 using one or more transponders 107 or transmitters. The subscriber receiving station 110 receives this information using the outdoor unit (ODU), which includes a subscriber antenna 112 having a feed that typically includes a plurality of low noise block converters (LNBs). LNBs convert the signal received from the satellite to another signal, typically at lower frequencies suitable for transmission via coaxial cable.

The LNBs are communicatively coupled (typically via the aforementioned coaxial cable) to a receiver 124. The receiver accepts the signal provided from the LNBs and processes that signal into a form suitable for a display or television. Since the electromagnetic signal is typically a modulated signal employing frequency domain and time domain modulation techniques (e.g. FDMA and TDMA) techniques, this involves demodulating the FDMA signal and selecting data packets having the desired information, assembling those packets into (typically MPEG) encoded digital streams, decoding those streams, then providing the decoded streams for display.

In one embodiment, the subscriber receiving station antenna is an 18-inch slightly oval-shaped Ku-band antenna. The slight oval shape is due to the 22.5 degree offset feed of the feed which is used to receive signals reflected from the subscriber antenna. The offset feed positions the LNB out of the way so it does not block any surface area of the antenna minimizing attenuation of the incoming microwave signal.

The distribution system 100 can comprise a plurality of satellites 108 in order to provide wider terrestrial coverage, to provide additional channels, or to provide additional bandwidth per channel. In one embodiment, each satellite comprises 16 transponders to receive and transmit program material and other control data from the uplink center 104 and provide it to the subscriber receiving stations 110. Using data compression and multiplexing techniques the multi-channel capabilities, two satellites 108 working together can receive and broadcast over 150 conventional (non-HDTV) audio and video channels via 32 transponders.

While this disclosure is made with reference to a satellite based distribution system 100, the systems and methods herein described may also be practiced with terrestrial-based transmission of program information, whether by broadcasting means, cable, or other means. Further, the different functions collectively allocated among the control center 102 and the uplink center 104 as described above can be reallocated as desired without departing from the intended scope of the disclosure.

Although the foregoing has been described with respect to an embodiment in which the program material delivered to the subscriber 122 is video (and audio) program material such as a movie, the foregoing method can be used to deliver program material comprising purely audio information or other data as well. It is also used to deliver current receiver software and announcement schedules for the receiver to rendezvous to the appropriate downlink 118. Link 120 may be used to report the receiver's current software version.

Figure 2:
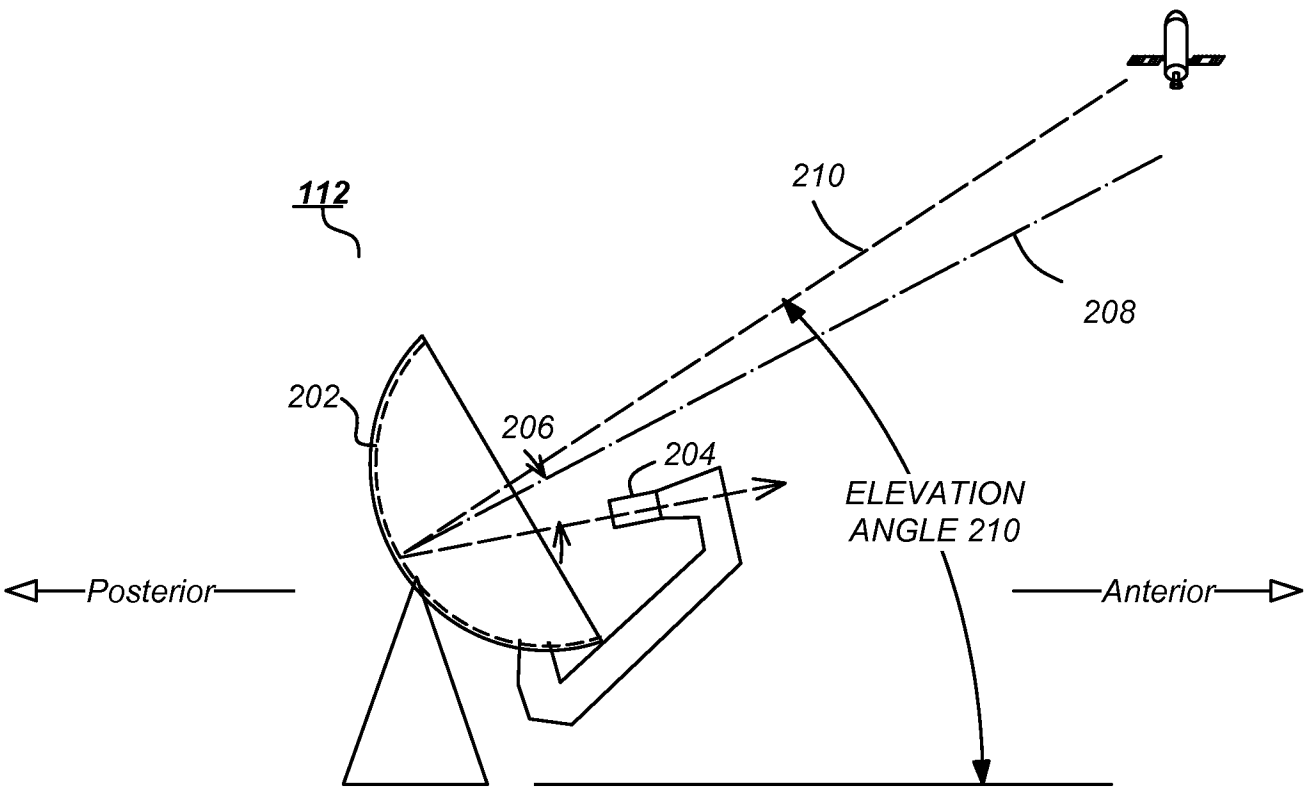
FIG. 2 is a diagram of one embodiment of the receive antenna.

FIG. 2 is a diagram of one embodiment of the satellite receive antenna 106. The satellite receive antenna 106 includes a parabolic reflector 202, which reflects and focuses the energy from the satellite transmitter or transponder 104 to a feed 204 having one or more (LNBs) 204 disposed at an angle 206 from the centerline 208 of the reflector 202. In one embodiment, angle 206 is approximately 22.5 degrees, but other geometries may be selected. Angle 206 positions the feed 204 out of the way to minimize attenuation of the incoming signal along the antenna centerline 208. Boresight 210 is directed towards the satellite 108 or source of the signal-carrying electromagnetic energy. The shape of the parabolic reflector 202 includes a slightly ovoid shape to account for the offset between the centerline 208 of the reflector 202 and the boresight 208.

The polar sensitivity characteristic of the satellite receive antenna 106 is a function of a number of interrelated physical and electrical antenna characteristics. These characteristics include, among other things, the sensitivity characteristics and physical location of the feed 204 relative to the reflector 202, and the shape of the surface of the reflector 202. For example, the feed 204 may be disposed closer to the surface of the reflector 202, but the focus of the parabolic reflector 202 (and hence its external surface contour) must be changed to account for this modified feed 204 location. Further, the beamwidth of the sensitive axis of the feed 204 must be modified to achieve the desired antenna sensitivity. Similarly, the feed 204 may be placed farther away from the reflector 202, and other antenna 106 parameters must be modified to reflect this difference.

To maximize the antenna 106 sensitivity along its boresight 210, it is desirable that the beamwidth of the sensitive axis of the feed 204 be wide enough to accept signals from as much of the reflector 202 surface as possible, including the outer periphery. At the same time, if the beamwidth of the feed 204 is too wide (exceeding the periphery of the reflector 202), spillover from behind the reflector 202 can be received by the feed 204. In such cases, the sensitivity characteristic of the antenna 106 will include sidelobes in the posterior (rear) side of the antenna 106 having a significant sensitivity.

Figure 3C:
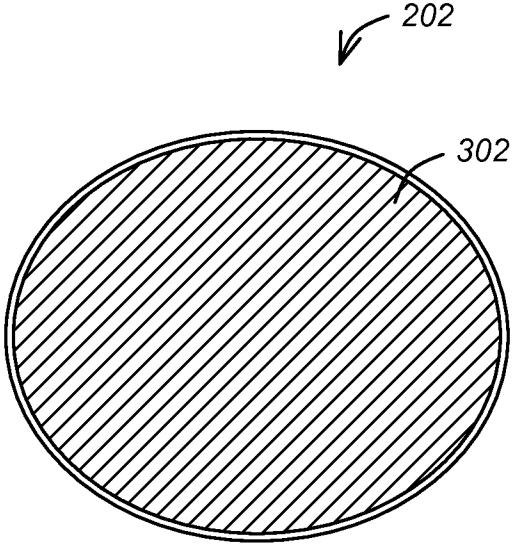
FIGS. 3A-3C are diagrams illustrating the reflector.
Figure 3B:
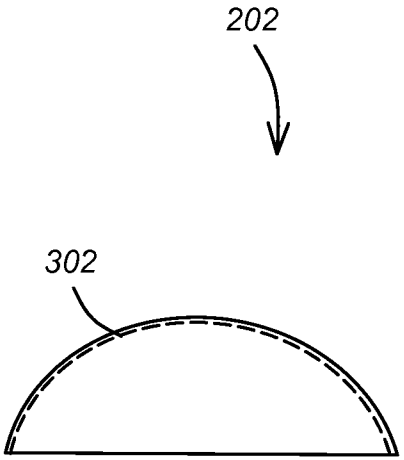
Figure 3A:
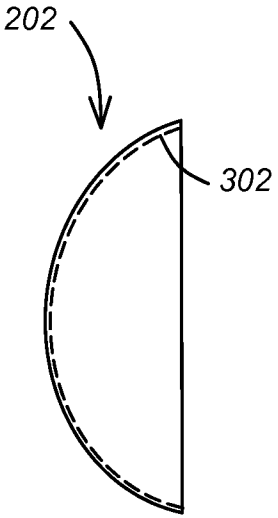

FIGS. 3A-3C are diagrams illustrating the reflector 202, including the reflector surface 302 facing the feed 204. FIGS. 3A and 3B presents a side view and top view of the reflector 202 respectively, while FIG. 3C presents the view from the perspective of the feed 204.

As described above, the reflector 202 may suffer accumulation of water (as snow, ice, or rain) during winter months. This snow and ice build up modifies the reflective characteristics of the reflector 202 (e.g. radiation efficiency due to scattering and/or absorption), and this causes attenuation in the signal provided to the feed 204. This attenuation, particularly in combination with other sources of attenuation (e.g. rain) may cause reception of the signal to be compromised, resulting in degraded picture quality, or no picture at all.

One technique to reduce the snow and ice build up is to treat the reflector 202 surface to reduce the adhesion of water, snow, and ice. Such treatment may include a coating such as superhydrophobic coatings available from ROSS NANOTECHNOLOGIES. The difficulties with such spray-on coatings is that they (1) add steps to the production process beyond which would otherwise be required and (2) the coating tends to degrade over time, as reflectors 202 can be exposed to harsh environmental conditions at both extremes for long periods of time. Further, the superhydrophobic properties of the coating can be seriously degraded if ordinary soap is used to "clean" the surface . . . something that a typical subscriber or their agent may do.

The processes discussed below reduce or eliminate the extra spray coating effects, yet still produce the required surface properties of the top-most painted layer of the reflector 202.

Typically, the surface coatings involve single or multiple coatings applied to the object. The coatings create surface properties which greatly reduce the adhesion of water on the surface. One metric for determining the hydrophobicity of the surface treatment is the contact angle of a water droplet on the treated surface. The surface is said to be superhydrophobic if this angle is greater than about 160 degrees, a value at which water droplets that form on the surface roll off solely under the influence of gravity.

The superhydrophobic properties of the coatings are the product of several surface properties. One key such property is surface roughness. Such roughness can be obtained by embedding nanoparticles ranging from 5 to 100 nanometers in largest dimension, to "roughen" the surface and create surface conditions that greatly increase water contact angles to 160 degrees and more.

As viewed under a microscope at about 100× magnification, the surface of an ordinary powder coating painted surface is remarkably flat and smooth. We describe techniques for producing surface conditions, including roughness, on a nano scale. These surface coatings have withstood harsh environmental conditions as well or better than existing methods.

Surface Roughening by Mixing Nanoparticles into Powder Coat

Currently, reflectors 202 are prepared by applying a dry powder coat of paint to the all or substantially all of the reflector surface 302, and applying sufficient heat to melt the paint particles in the powder coat so that they adhere to the surface. Steps may be undertaken to prepare the surface (typically metallic or galvanized metallic) to increase the adhesion of the paint to the surface.

A first approach to provide the surface roughening required for superhydrophobic properties is to mix nanoparticles having a higher melting temperature than the dry powder coat particles into the dry powder and apply the combination to the reflector surface 302 before the heating step. Since the nanoparticles have a sufficiently higher melting point, they remain in a solid state, with the paint particles forming around them.

After cooling and/or drying, the nanoparticles become embedded in the dry paint, resulting in nano surface features on a nano scale and of the size and distribution required for superhydrophobic properties. In one embodiment, the nanoparticles are silicate based and have a substantially higher melting point than the dry powder coat. The nanoparticles may also be formed of a shape that assures their proper orientation following the heating and cooling (drying) process. Hence, the nanoparticles become an integral part of the surface coating, providing a composite material with the necessary surface features.

In applications wherein the orientation and distribution of nanoparticles are important for superhydrophobic performance, techniques may be employed to assure the proper distribution of the nanoparticles, before, during, or after the heating process. For example, the characteristics of the dry powder coat particles and nano particles can be selected such that after application of the dry powder and nano particle composite, the reflector 204 may be shaken, vibrated, or otherwise physically moved so that the nanoparticles rise to the surface of the composite, and/or are more evenly distributed on the surface. This can be accomplished, for example, by selecting the appropriate dry powder paint particle size relative to the nanoparticle size.

Surface Roughening by Mixing Nanoparticles into Wet Paint

Another approach similar to that above is to use a wet painting process. With this process, nanoparticles are mixed with liquid paint (instead of the dry powder coat particles), and applied to all or substantially all of the reflector surface 302 using a liquid spraying process.

Surface Roughening Via Erosion of the Painted Reflector Surface

Another technique for hydrophobically treating the reflector surface 302 is to pattern the surface 302 itself. This can be accomplished, for example, by "sandblasting" the painted surface with very fine grit materials to produce suitably nano-sized surface features. The fine grit needed for such patterning may include particles greater than the desired nano-sized, so long as the result is that the eroded surface of the reflector 302 has surface features of the proper size. The fine grit may also be recovered for re-use.

Alternatively, the surface 302 of the reflector 204 may be painted (either by application of liquid paint, or dry powder coat followed by heat), and before the painted surface dries/cools, the surface can be patterned by the application of ephemeral nano particles such as water. The impact of the water nanoparticles pattern the surface as required, then evaporate, leaving only the patterned surface without nanoparticles. Since the surface roughness required for superhydrophobic performance requires feature sizes of up to only 100 nanometer (0.1 micrometer) and paint thicknesses are typically about 500-100 micrometers, no changes are required to the process of establishing the a paint layer for later erosion.

Embedding Nanoparticles in the Top Layer of a Painted Surface

Another technique for hydrophobically treating the reflector surface 302 is to first paint the surface, and then force spray nanoparticles of appropriate size while the paint is still tactile, thereby enabling the nanoparticles to become embedded in the top layer of the painted surface. Using dry powder painting techniques, this can be accomplished by applying the dry powder coat, heating the powder coated reflector surface, thus melting the dry powder coat. As the painted surface cools down, but while the paint is of the right softness, nanoparticles can be embedded into the surface using a nanoparticle spraying process. This can be accomplished, for example, by incorporating the nanoparticles in a solvent that holds the nanoparticles in suspension during the spray process, and which evaporates away upon cooling of the surface or by simply spraying dry nanoparticles on the surface.

Optimized Hydrophobic Treatment of Antenna Reflector

Figure 4A:
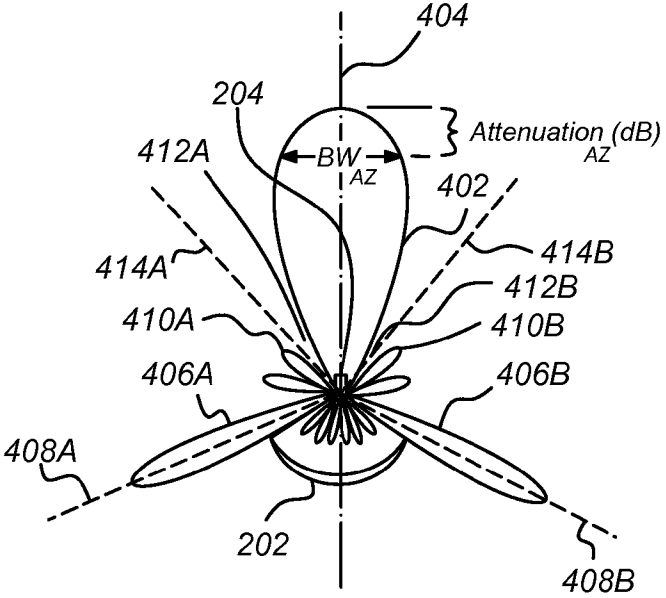
FIGS. 4A and 4B are diagrams depicting the sensitivity characteristic of a representative satellite receive antenna.
Figure 4B:
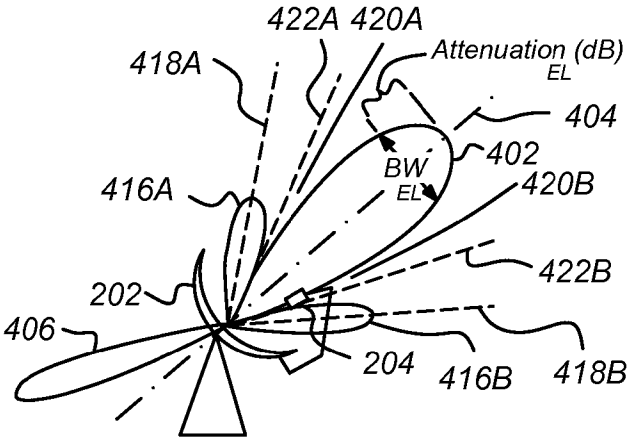

FIGS. 4A and 4B are diagrams depicting the sensitivity characteristic of a representative satellite receive antenna 106. FIG. 4A depicts an azimuthal slice of the antenna characteristic, while FIG. 4B shows a slice along the elevation direction at a zero azimuth angle.

FIG. 4A discloses an azimuthal sensitivity characteristic including an anteriorly-disposed main lobe 402 substantially aligned along a primary sensitive axis 404 coincident with the boresight 210, and a plurality of sidelobes 410A, 410B, 406A, and 406B. Nulls such as null 412A and null 412B are disposed between the sidelobes 410A, 410B, 406A, and 406B. Nulls 412A and 412B are disposed substantially along null axes 414A and 414B. Posterior sidelobes 406A and 406B are substantially along secondary sensitive axes 408A and 408B, respectively. The posterior sidelobes 406A and 406B are the result of satellite receive antenna design compromises, resulting, among other things, in spillover from the rear of the reflector 202 to the LNB 204.

FIG. 4B discloses an elevation sensitivity characteristic including the main lobe 402, sidelobes 416A and 416B substantially along sidelobe axes 418A and 418B. Nulls 422A and 422B are disposed along null axes 422A and 422B, respectively, between the main lobe 402 and the sidelobes 416A and 416B, as well as between other sidelobes not illustrated. The depictions of the main 402 and sidelobes in FIGS. 4A and 4B above are intended to be representative depictions of the polar sensitivity characteristic of a satellite receive antenna 106 by which the disclosure may be practiced, other polar sensitivities are possible. The beamwidth (BW) of the antenna is sometimes expressed as the extent of an angle off of boresight 404 in which the antenna sensitivity is attenuated by a particular amount. Typically, for example, the BW of the antenna is the angular extent that for which the antenna sensitivity to the electromagnetic energy is no more than 3 dB below the peak value at boresight 404. As shown in FIGS. 4A and 4B, these values are typically expressed in both elevation and azimuth.

As can be seen in FIGS. 4A and 4B, different surfaces of the reflector 202 reflect different amounts of electromagnetic energy, due to their geometrical proximity to the feed 204, and the source of electromagnetic energy. In addition, in the main lobe 404, more energy is concentrated at the center of the lobe 404 than is near nulls 420A and 420B.

Figure 5:
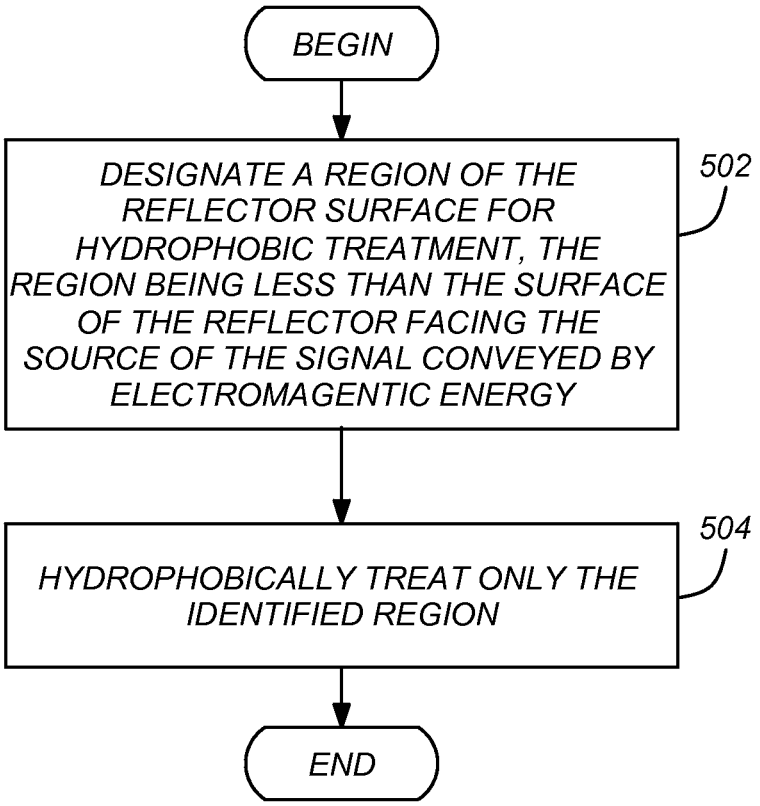
FIG. 5 is a diagram presenting a flow chart of an exemplary process for hydrophobically coating the reflector surface.

FIG. 5 is a diagram presenting a flow chart of an exemplary process for hydrophobically coating the reflector surface 302. As described above, the process of hydrophobically treating the reflector surface 302 can be expensive. Such expense can be reduced through judicious application of the hydrophobic process to portions of the antenna reflector 204 that are most important for the adequate reception of the electromagnetic energy carrying the signal. This area or region may be hereinafter referred to as the "critical" region.

Figure 6C:
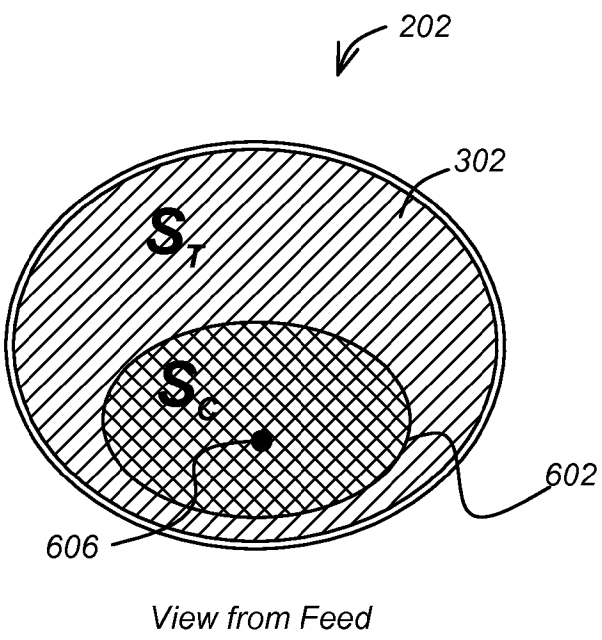
FIGS. 6A-6C are diagrams presenting an embodiment of an antenna reflector having a surface including a critical region that is hydrophobically treated.
Figure 6B:
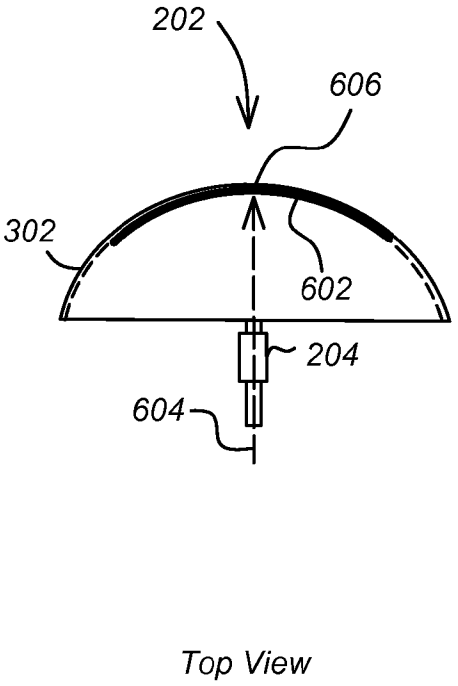
Figure 6A:
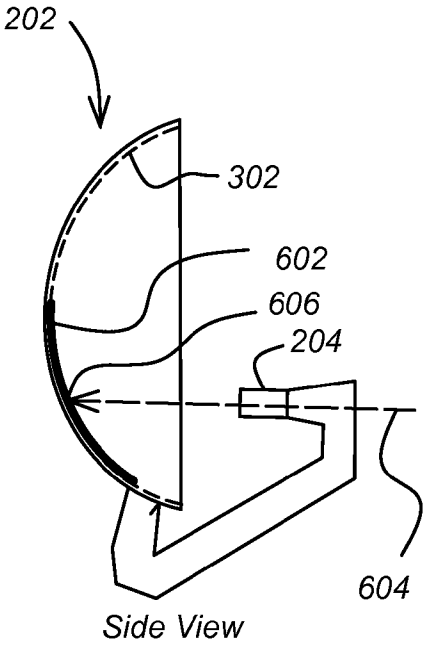

FIGS. 6A-6C are diagrams presenting an embodiment of an antenna reflector 202 having a surface 302 including a critical region 602 that is hydrophobically treated, and a location 606 where the feed 204 boresight 604 is incident on the reflector surface 302. FIG. 6A presents a side view of the antenna 202, while FIG. 6B presents a top view, and FIG. 6C presents the view from the perspective of the feed 204. FIGS. 6A-6C are discussed below with reference to FIG. 5.

Turning to FIG. 5, block 502 describes designating a region of the reflector surface 302 for hydrophobic treatment. In the illustrated embodiment, the region is a critical region 602 that is less than the surface 302 of the reflector 202. In one embodiment, the region is designated according to an amount of electromagnetic energy from the signal reflected by the region 602 to the feed 204, and may be substantially elliptical in shape having a center that is substantially co-linear with a the boresight 604 of the feed 204. Due at least in part to the offset feed 204 design described herein, the center of the critical region is generally not coincident with the center of the reflector surface 302 itself.

The total area of the critical region 602 may be defined in terms of a surface area fraction $$S = \frac{S_C}{S_T}$$

wherein $S_T$=the surface area of the entire reflector surface facing the source of electromagnetic energy and $S_C$=the surface area of the critical region. In this case, the power loss $P_L$ in decibels is related to the surface area fraction of the region S according to the following approximate relationship:

$$P_L = 1.0 - a^{bS+c_1} + c_2 \qquad \text{Equation (1)}$$

wherein:

a=first constant approximately equal to 3.448;

b=second constant approximately equal to −5.138;

$c_1$=third constant approximately equal to 1.949; and $c_2$=fourth constant approximately equal to −0.98.

Figure 7:
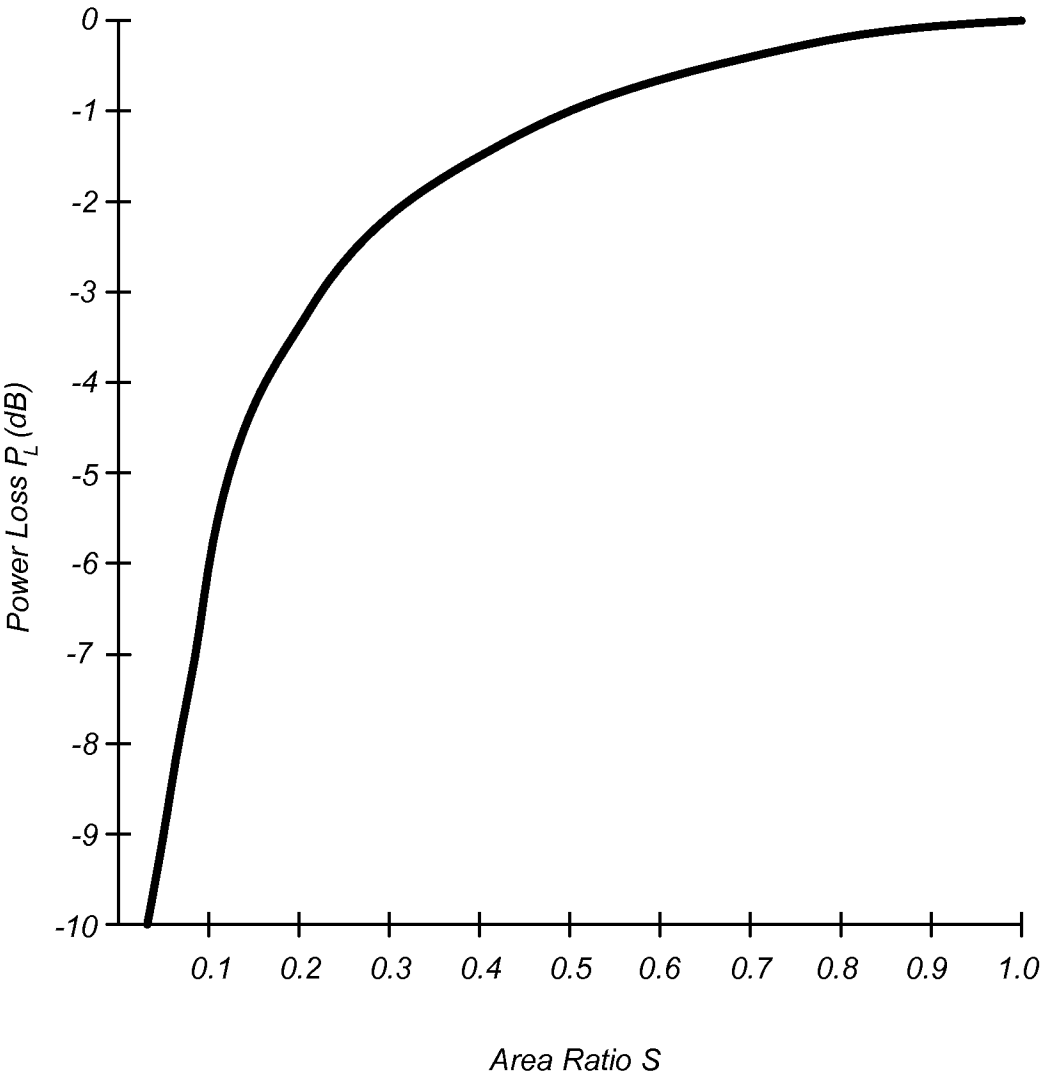
FIG. 7 is a diagram illustrating a relationship between the power loss $P_L$ and surface area fraction, S.

FIG. 7 is a diagram illustrating the foregoing relationship between the power loss $P_L$ and surface area fraction, S. Note that the critical region for hydrophobic treatment can be sized according to acceptable power loss for a particular feed 204 (or LNB) and receiver combination. Receivers and/or LNBs with greater sensitivity may be utilized with antenna reflectors having smaller hydrophobic treatment areas, while receivers and/or LNBs with lesser sensitivity may require hydrophobic treatment over larger areas. It is notable from FIG. 7 that the loss for a surface area fraction of 0.25 is approximately 3 dB, indicating that the critical region 602 may comprise only one quarter of the area of the reflector, offering significant savings.

Selection of the appropriate surface area fraction S is a matter of determining how much power loss can be budgeted to this source, and still provide adequate performance. If the acceptable power loss $P_L$ attributed to this source (coating less than the entire reflective surface) is −0.5 dB, the sufficient reception performance may be obtained, while reducing the treatment area by approximately 30% (S=0.7). In more aggressive applications where larger savings may be desired or required, approximately 2 dB of power loss can be budgeted to this source, reducing the treated area by about 67%, resulting in significant savings. On the other hand, since the contributors to the total power loss include other factors such as antenna aiming errors and the like, power loss greater than 3-4 dB budgeted to this source may result in seriously degraded performance.

Figure 8:
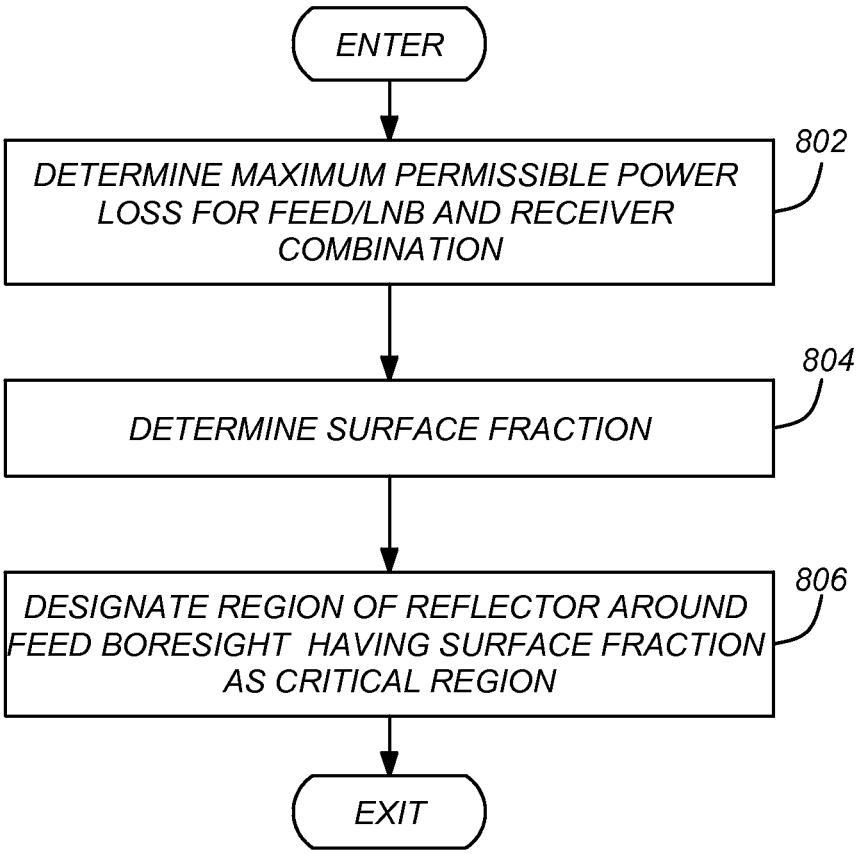
FIG. 8 is a diagram depicting exemplary process steps that can be used to designate the critical region of the reflector.

FIG. 8 is a diagram depicting exemplary process steps that can be used to designate the critical region 602 of the reflector 202. Block 802 illustrates determining the maximum permissible power loss for a feed 206 and receiver 124 combination. Other factors that may be considered is the intended installation location of the antenna 102, as some geographic areas are more apt to be affected by rain, snow and ice. Thus, if a given probabilistic value of uninterrupted service is desired, antennas 202 installed in some regions may require a greater critical area 602 than other antennas. Block 804 illustrates determining the surface fraction of the critical region 602 using the maximum permissible power loss. This can be accomplished, for example, by use of Equation (1) above, or the plot shown in FIG. 7. Different equation constants or plots may be required for different antenna designs. Finally, block 806 illustrates designating the critical region 602 of the reflector surface 302 as the region around the location 606 where the feed boresight intersects the reflector surface having the determined surface fraction. The shape of the region 606 depends upon the relationship between the azimuthal and elevational sensitivity of the reflector 202 feed 204 combination, with the sensitivity in both axes typically Gaussian.

Figure 9:
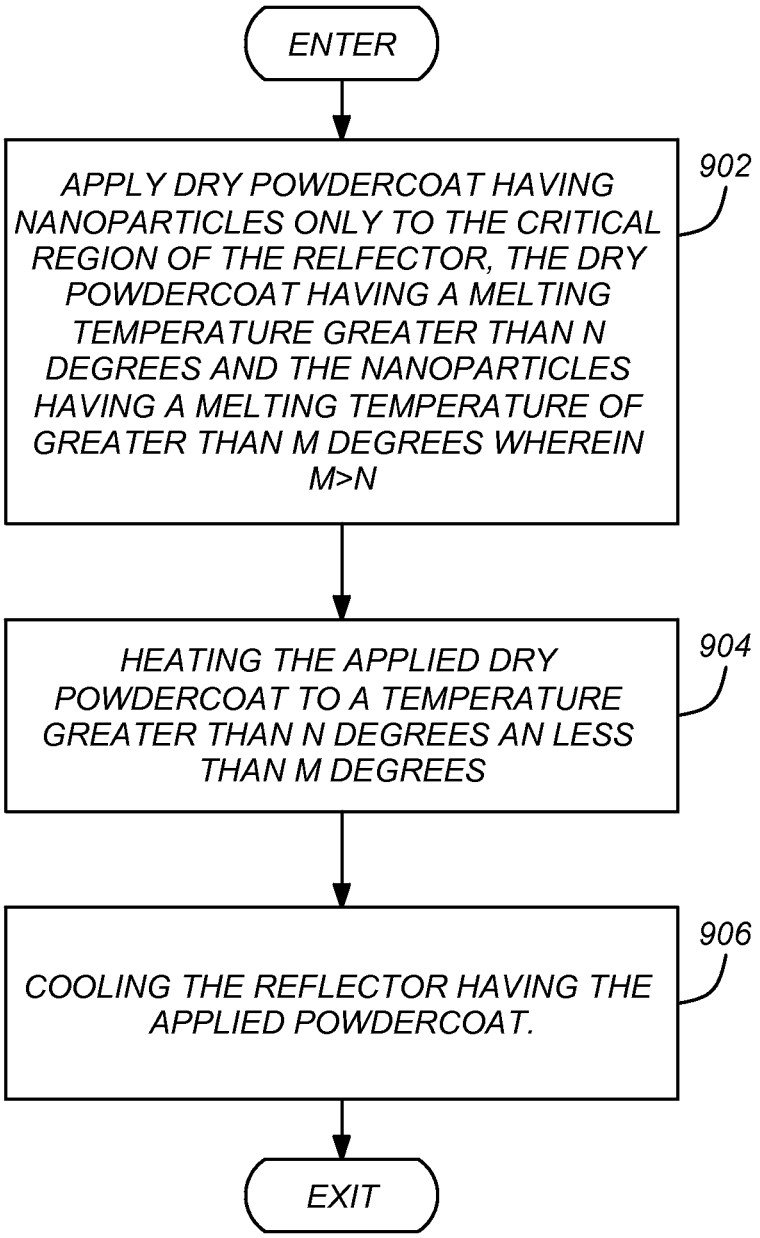
FIG. 9 is a diagram depicting exemplary process steps that can be used to hydrophobically treat only the identified region.

FIG. 9 is a diagram depicting exemplary process steps that can be used to hydrophobically treat only the identified region, as described in block 504 of FIG. 5. Block 902 illustrates applying a dry powder coat having nanoparticles only to the critical region of the reflector. In one embodiment, the dry powder coat particles have a melting temperature greater than N degrees, and the nanoparticles have a melting temperature greater than M degrees, where M>N. In block 904, the reflector having the applied dry powder coat is heated to a temperature greater than N degrees and less than M degrees, effectively melting the powder coat particles, but leaving the nanoparticles in the solid state. Once that is accomplished, the reflector 202 and coating is cooled, as shown in block 906. The process shown in FIG. 9 may be varied. For example, the operation of block 904 may involve the heating of the entire reflector surface with the powder coat and nanoparticles applied only to the critical region of the reflector surface 302. Conversely, the dry powder coat having the nanoparticles may be applied to the entire reflector surface, with only the critical region heated to greater than N degrees and less than M degrees. Following cooling, the unmelted powder coat (with the unmelted nanoparticles) can be recovered and used to prepare another reflector.

Different techniques can be used to perform the operation shown in block 902. In one embodiment, only the critical region surface of the reflector 302 is treated so that the dry powder coat having the nanoparticles adheres to only that portion of the surface of the reflector, then the powder coat and nanoparticles are applied to the entire reflector. Such treatment may involve the application of a substance that is somewhat adhesive to the dry powder coat, or may involve the application of sufficient heat to the reflector surface 302, so that the only the critical region 604 exceeds N degrees and is less than M degrees. Powder coat and nanoparticles in areas other than the critical region may be removed (e.g. by blowing air or inert gas) and can be recovered for use with other reflectors. Alternatively, the dry powder coat and nanoparticles can simply be placed only in the critical region 604 (e.g. by spraying the combination only in the critical region or masking off undesired regions before spraying the combination on the entire reflector surface), or nanoparticles may be applied to the entire reflector surface 302, but only the critical region 602 is heated.

Figure 10:
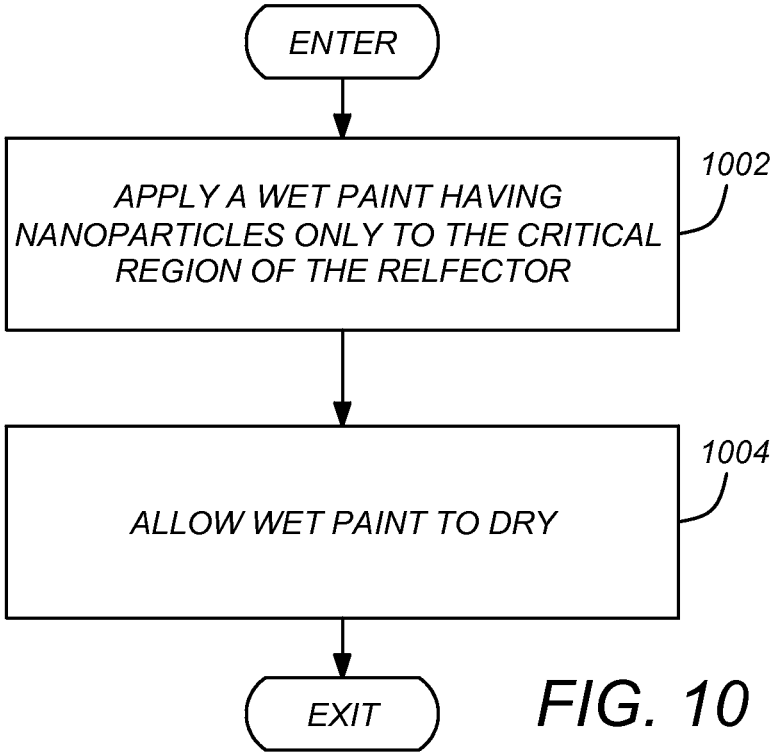
FIG. 10 is a diagram illustrating alternative exemplary process steps that can be used to hydrophobically treat only the identified region.

FIG. 10 is a diagram illustrating alternative exemplary process steps that can be used to hydrophobically treat only the identified region. In block 1002, a wet paint or powder coat having nanoparticles is applied only to the critical region 602 of the reflector 202. In block 1004, the applied wet paint is allowed to dry/cure.

Figure 11:
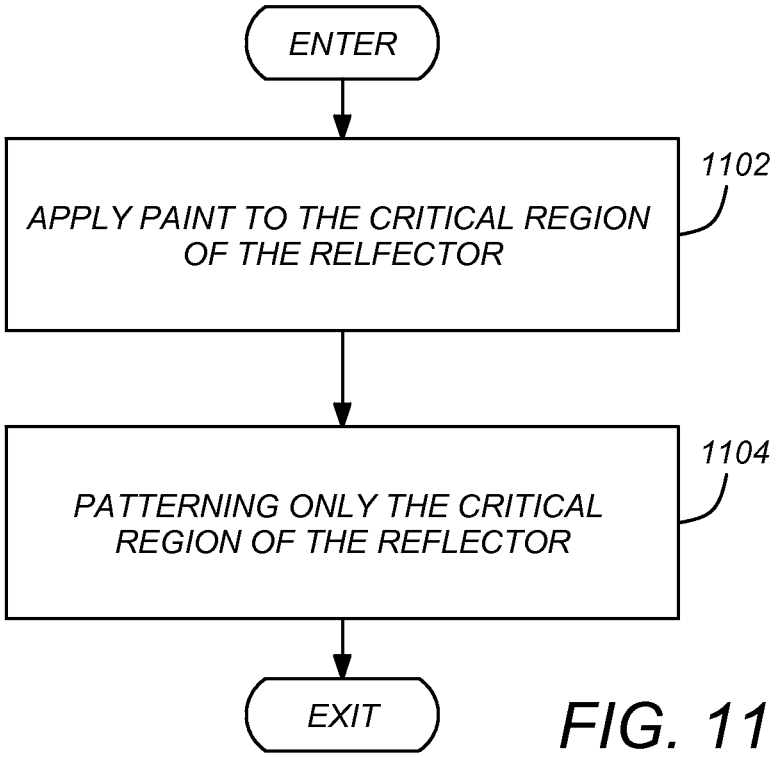
FIG. 11 is a diagram illustrating other alternative exemplary process steps that can be used to hydrophobically treat only the identified region.

FIG. 11 is a diagram illustrating other alternative exemplary process steps that can be used to hydrophobically treat only the identified region. In block 1102, a paint or powder coat is applied to the critical region 602 of the reflector 202, and allowed to cure or dry. The paint may be applied to only the critical region 602, or the entire surface 302 of the reflector 202 facing the feed 204. In block 1104, only the critical region of the reflector 202 is patterned to create nanoparticle-sized features. In one embodiment, this is accomplished by sandblasting the critical region of the painted reflector surface. In one embodiment, the thickness of the applied paint is at least 100 nanometers, allowing for enough of a painted surface to permit the desired nanoparticle-sized features.

Figure 12C:
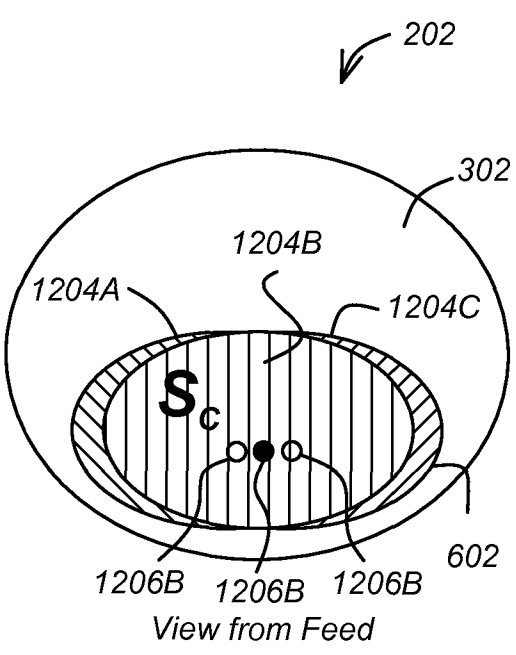
FIGS. 12A-12C are diagrams illustrating another alternative exemplary embodiment of the treated antenna reflector.
Figure 12B:
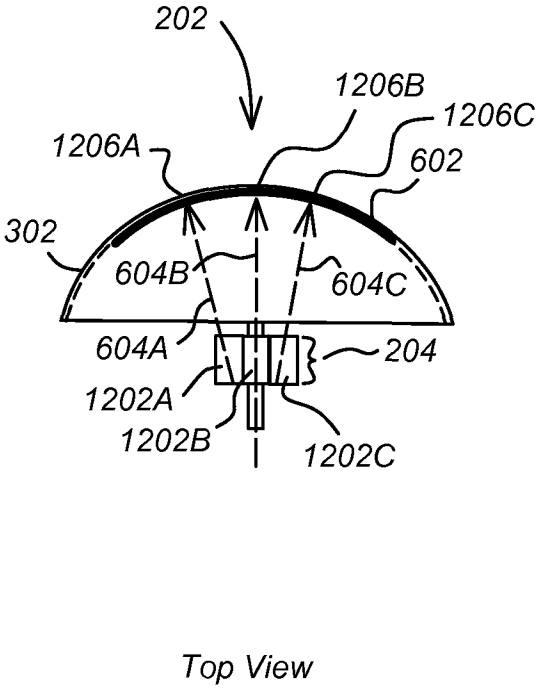
Figure 12A:
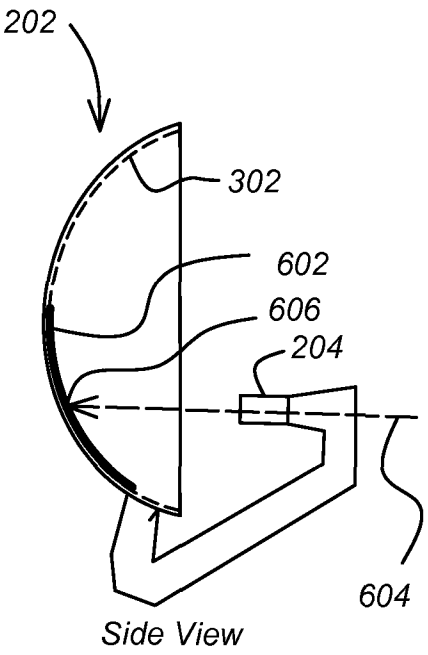

FIGS. 12A-12C are diagrams illustrating another alternative exemplary embodiment of the treated antenna reflector 202. While the distribution system 100 illustrated in FIG. 1 illustrates only one signal source (e.g. one satellite 108), some distribution systems comprise multiple signal sources in different locations (e.g. multiple satellites, each in a different orbital slot or multiple terrestrial transmitters, each in a different location). In cases where the signal sources are in close angular proximity, a single antenna 112 can be used to receive signals from all of the signal sources by use of a single reflector with multiple LNBs 1202A-1202C, each placed at a slightly different focal point of the reflector 202. The result is that each of the LNBs 1202 receives signals along a boresight angularly displaced from the other LNBs 1202, with each LNB 1202 thus receiving signals from a different one of the multiple transmitters. Hence, each LNB 1202A-1202C receives signals reflecting from slightly different portions of the reflector 202, as illustrated by portions 1204A-1204C, respectively. Although the difference in the regions is typically small and because the majority of the signal strength received by each LNB comes from the center of the pattern of reflected energy (e.g. boresight), this difference can be accounted for by increasing the horizontal dimension of the elliptical shape of the critical region. Typically, this amount can be computed by determining the critical region 1204A-1204C for each LNB 1202A-1202C and identifying the critical region for hydrophobic treatment as the union of all regions 1204A-1204C.

Hardware Environment

Figure 13:
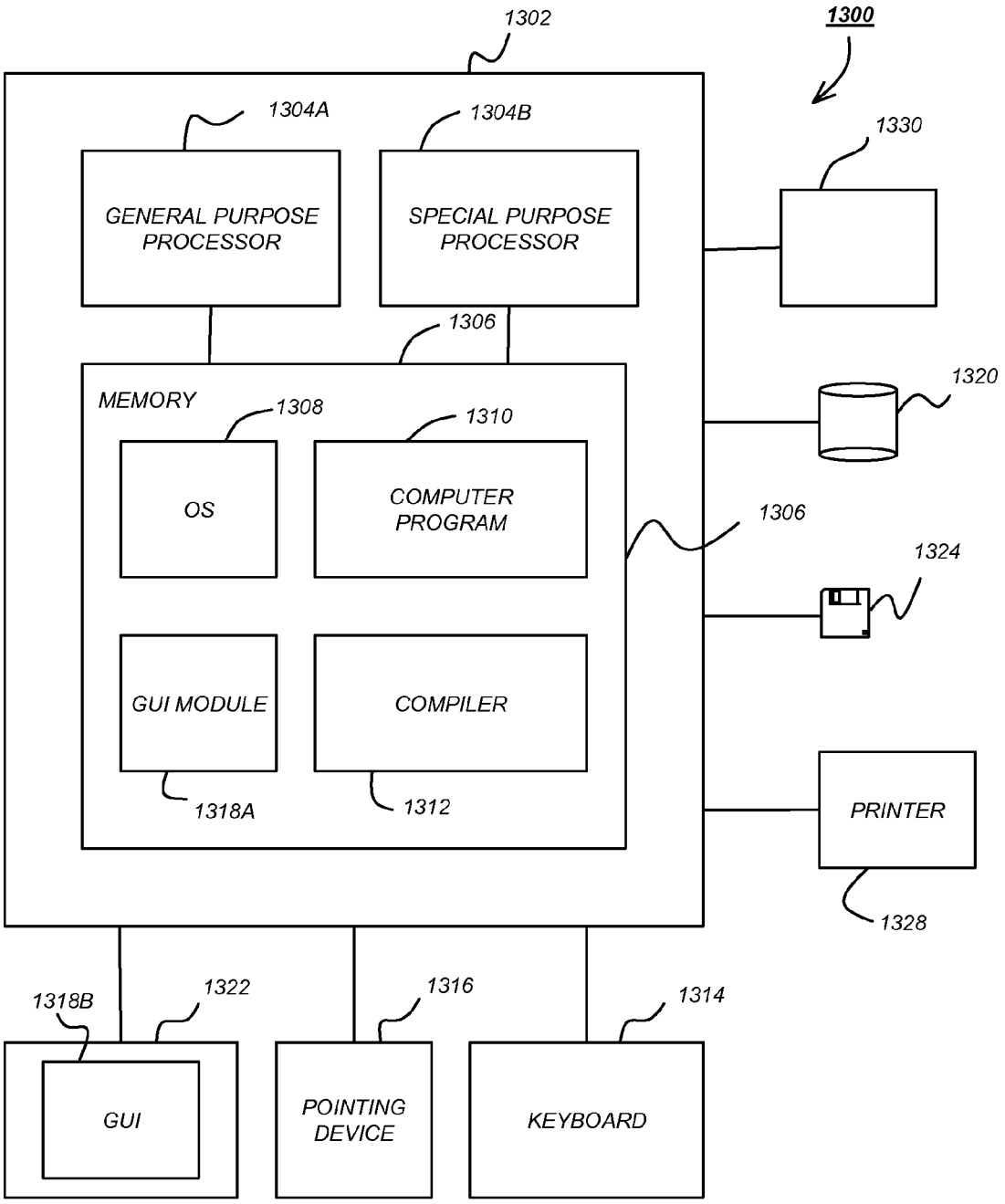
FIG. 13 is a diagram illustrating an exemplary processor system that can be used to practice embodiments based on this disclosure.

FIG. 13 is a diagram illustrating an exemplary computer system 1300 that could be used to implement elements described above, including designating the region for hydrophobic treatment and controlling devices that hydrophobically treat the identified region. The computer 1302 comprises a general purpose hardware processor 1304A and/or a special purpose hardware processor 1304B (hereinafter alternatively collectively referred to as processor 1304) and a memory 1306, such as random access memory (RAM). The computer 1302 may be coupled to other devices, including input/output (I/O) devices such as a keyboard 1314, a mouse device 1316 and a printer 1328.

In one embodiment, the computer 1302 operates by the general purpose processor 1304A performing instructions defined by the computer program 1310 under control of an operating system 1308. The computer program 1310 and/or the operating system 1308 may be stored in the memory 1306 and may interface with the user and/or other devices to accept input and commands and, based on such input and commands and the instructions defined by the computer program 1310 and operating system 1308 to provide output and results.

Output/results may be presented on the display 1322 or provided to another device for presentation or further processing or action. In one embodiment, the display 1322 comprises a liquid crystal display (LCD) having a plurality of separately addressable pixels formed by liquid crystals. Each pixel of the display 1322 changes to an opaque or translucent state to form a part of the image on the display in response to the data or information generated by the processor 1304 from the application of the instructions of the computer program 1310 and/or operating system 1308 to the input and commands. Other display 1322 types also include picture elements that change state in order to create the image presented on the display 1322. The image may be provided through a graphical user interface (GUI) module 1318A. Although the GUI module 1318A is depicted as a separate module, the instructions performing the GUI functions can be resident or distributed in the operating system 1308, the computer program 1310, or implemented with special purpose memory and processors.

Some or all of the operations performed by the computer 1302 according to the computer program 1310 instructions may be implemented in a special purpose processor 1304B. In this embodiment, some or all of the computer program 1310 instructions may be implemented via firmware instructions stored in a read only memory (ROM), a programmable read only memory (PROM) or flash memory within the special purpose processor 1304B or in memory 1306. The special purpose processor 1304B may also be hardwired through circuit design to perform some or all of the operations herein described. Further, the special purpose processor 1304B may be a hybrid processor, which includes dedicated circuitry for performing a subset of functions, and other circuits for performing more general functions such as responding to computer program instructions. In one embodiment, the special purpose processor is an application specific integrated circuit (ASIC).

The computer 1302 may also implement a compiler 1312 which allows an application program 1310 written in a programming language such as COBOL, C++, FORTRAN, or other language to be translated into processor 1304 readable code. After completion, the application or computer program 1310 accesses and manipulates data accepted from I/O devices and stored in the memory 1306 of the computer 1302 using the relationships and logic that was generated using the compiler 1312.

The computer 1302 also optionally comprises an external communication device such as a modem, satellite link, Ethernet card, or other device for accepting input from and providing output to other computers.

In one embodiment, instructions implementing the operating system 1308, the computer program 1310, and/or the compiler 1312 are tangibly embodied in a computer-readable medium, e.g., data storage device 1320, which could include one or more fixed or removable data storage devices, such as a zip drive, floppy disc drive 1324, hard drive, CD-ROM drive, tape drive, or a flash drive. Further, the operating system 1308 and the computer program 1310 are comprised of computer program instructions which, when accessed, read and executed by the computer 1302, cause the computer 1302 to perform the steps necessary to implement and/or use the techniques and elements described herein to load the program of instructions into a memory, thus creating a special purpose data structure causing the computer to operate as a specially programmed computer executing the method steps described herein. Computer program 1310 and/or operating instructions may also be tangibly embodied in memory 1306 and/or data communications devices 1330, thereby making a computer program product or article of manufacture. As such, the terms "article of manufacture," "program storage device" and "computer program product" or "computer readable storage device" as used herein are intended to encompass a computer program accessible from any computer readable device or media.

Of course, those skilled in the art will recognize that any combination of the above components, or any number of different components, peripherals, and other devices, may be used with the computer 1302.

Although the term "computer" is referred to herein, it is understood that the computer may include portable devices such as cellphones, portable MP3 players, video game consoles, notebook computers, pocket computers, or any other device with suitable processing, communication, and input/output capability.

CONCLUSION

This concludes this disclosure. The foregoing description of the presented embodiments has been described for the purposes of illustration. It is not intended to be exhaustive or to limit the scope of this disclosure to the precise form disclosed. Many modifications and variations are possible in light of the above teaching. For example, while the disclosed design is disclosed in conjunction with a satellite transmission system, the foregoing can be used with any antenna utilizing reflective surfaces to transmit electromagnetic energy to devices that sense them, including terrestrial antennas. It is intended that the scope be limited not by this detailed description, but rather by the claims appended hereto.

What is claimed is:

1. In an antenna for receiving a signal conveyed by electromagnetic energy, the antenna having a reflector having a reflector surface reflecting the electromagnetic energy to a feed, a method of applying hydrophobic coating to the reflector, comprising:

designating a region of the reflector surface for hydrophobic treatment, the region being less than the surface of the reflector facing a source of the electromagnetic energy; and hydrophobically treating only the region of the reflector surface;

wherein the region is designated according to a predicted amount of electromagnetic energy from the signal reflected by the region to the feed.

2. The method of claim 1, wherein the region is an elliptical region having a center co-linear with a boresight of the feed.

3. The method of claim 2, wherein a surface area fraction of the region S is approximately related to power loss $P_L$ in decibels approximately according to:

$$P_L=1.0-a^{bS+c_1}+C_2, \text{ wherein:}$$

S=surface area of the region/surface area of the reflector;

a=a first constant approximately equal to 3.448;

b=a second constant approximately equal to −5.138;

$c_1$=a third constant approximately equal to 1.949; and $c_2$=a fourth constant approximately equal to −0.98.

4. The method of claim 3, wherein the surface area is selected for a power loss of approximately −0.5 dB.

5. The method of claim 3, wherein the surface area is selected for a power loss of approximately −2.0 dB.

6. The method of claim 3, wherein hydrophobically treating only the region of the reflector surface comprises:

applying a dry powder coat having nanoparticles only to the region of the reflector, the dry powder coat having a melting temperature greater than N degrees and the nanoparticles having a melting temperature greater than M degrees wherein M>N; and heating the applied dry powder coat to a temperature greater than N degrees and less than M degrees.

7. The method of claim 3, wherein hydrophobically treating only the region of the reflector surface comprises:

applying a dry powder coat having nanoparticles to the surface of the reflector, the dry powder coat having a melting temperature greater than N degrees and the nanoparticles having a melting temperature greater than M degrees wherein M>N; and heating only the portion of the dry powder coat applied to the region of the reflector to a temperature greater than N degrees and less than M degrees.

8. The method of claim 3, wherein hydrophobically treating only the region of the reflector surface comprises:

applying a wet paint having nanoparticles only to the region of the reflector, the wet paint having nanoparticles.

9. The method of claim 3, wherein:

the reflector surface is a painted surface having a thickness of at least 100 nanometers; and hydrophobically treating only the region of the reflector surface comprises patterning only the region of the painted reflector surface.

10. The method of claim 9, wherein the step of patterning only the region of the reflector surface comprises sandblasting only the region of the painted reflector surface.

11. An antenna for receiving a signal conveyed by electromagnetic energy, comprising:

a reflector, having a reflective surface for reflecting the electromagnetic energy; and a feed, for receiving the reflected electromagnetic energy;

wherein the reflector surface comprises:

a hydrophobically treated region consisting of less than the surface of the reflector facing a source of the electromagnetic energy; and a hydrophobically untreated surface consisting of a remainder of the surface of the reflector facing the source of the electromagnetic energy;

wherein the region is designated according to a predicted amount of electromagnetic energy from the signal reflected by the region to the feed.

12. The antenna of claim 11, wherein:

the hydrophobically treated region comprises:

a first hydrophobically treated region; and a second hydrophobically treated region, concentric with the first hydrophobic region;

wherein the first hydrophobic region comprises first hydrophobic characteristics and the second hydrophobic region comprises second hydrophobic characteristics.

13. The antenna of claim 11, wherein the region is an elliptical region having a center co-linear with a boresight of the feed.

14. The antenna of claim 13, wherein a surface area fraction of the region S is approximately related to power loss $P_L$ in decibels approximately according to:

$$P_L=1.0-a^{bS+c_1}+c_2, \text{ wherein:}$$

S=surface area of the region/surface area of the reflector a=a first constant approximately equal to 3.448;

b=a second constant approximately equal to −5.138;

$c_1$=a third constant approximately equal to 1.949; and $c_2$=a fourth constant approximately equal to −0.98.

15. The antenna of claim 14, wherein the surface area is selected for a power loss of approximately −0.5 dB.

16. The antenna of claim 14, wherein only the region of the reflector surface is hydrophobically treated by:

applying a dry powder coat having nanoparticles only to the region of the reflector, the dry powder coat having a melting temperature greater than N degrees and the nanoparticles having a melting temperature greater than M degrees wherein M>N; and heating the applied dry powder coat to a temperature greater than N degrees and less than M degrees.

17. The antenna of claim 14, wherein only the region of the reflector surface is hydrophobically treated by:

applying a dry powder coat to the reflector, the dry powder coat having nanoparticles having a melting temperature greater than N degrees; and heating only the portion of the dry powder coat applied to the region of the reflector to a temperature greater than N degrees and less than M degrees.

18. The antenna of claim 14, wherein only the region of the reflector surface is hydrophobically treated by:

applying a wet powder coat having nanoparticles only to the region of the reflector, the wet powder coat having nanoparticles.

19. The antenna of claim 18, wherein the reflector surface is a painted surface having a thickness of at least 100 nanometer, wherein only the region of the reflector surface is hydrophobically treated by patterning only the region of the painted reflector surface.

20. The antenna of claim 19, wherein the only the region of the reflector surface is patterned by sandblasting only the region of the painted reflector surface.

21. A reflector for reflecting a signal conveyed by electromagnetic energy to a feed, comprising:

a surface, facing a source of the electromagnetic energy, including:

a hydrophobically treated region consisting of less than the surface of the reflector facing the source of the electromagnetic energy; and a hydrophobically untreated region consisting of a remainder of the surface of the reflector facing the source of the electromagnetic energy;

wherein the region is designated according to a predicted amount of electromagnetic energy from the signal reflected by the region to the feed.

22. The reflector of claim 21 wherein:

the hydrophobically treated region comprises:

a first hydrophobically treated region; and a second hydrophobically treated region, concentric with the first hydrophobic region;

wherein the first hydrophobic region comprises first hydrophobic characteristics and the second hydrophobic region comprises second hydrophobic characteristics.

23. The reflector of claim 21, wherein the region is an elliptical region having a center co-linear with a boresight of the feed.

24. The reflector of claim 23, wherein a surface area fraction of the region S is approximately related to power loss $P_L$ in decibels approximately according to:

$$P_L=1.0-a^{bS+c_1}+c_2, \text{ wherein:}$$

S=surface area of the region/surface area of the reflector a=a first constant approximately equal to 3.448;

b=a second constant approximately equal to −5.138;

$c_1$=a third constant approximately equal to 1.949; and $c_2$=a fourth constant approximately equal to −0.98.

25. The reflector of claim 24, wherein the surface area is selected for a power loss of approximately −0.5 dB.

26. The reflector of claim 24, wherein only the region of the reflector surface is hydrophobically treated by:

applying a dry powder coat having nanoparticles only to the region of the reflector, the dry powder coat having a melting temperature greater than N degrees and the nanoparticles having a melting temperature greater than M degrees wherein M>N; and heating the applied dry powder coat to a temperature greater than N degrees and less than M degrees.

27. The reflector of claim 24, wherein only the region of the reflector surface is hydrophobically treated by:

applying a dry powder coat to the reflector, the dry powder coat having nanoparticles having a melting temperature greater than N degrees; and heating only the portion of the dry powder coat applied to the region of the reflector to a temperature greater than N degrees and less than M degrees.

28. The reflector of claim 24, wherein only the region of the reflector surface is hydrophobically treated by:

applying a wet powder coat having nanoparticles only to the region of the reflector, the wet powder coat having nanoparticles.

29. The reflector of claim 28, wherein the reflector surface is a painted surface having a thickness of at least 100 nanometer, wherein only the region of the reflector surface is hydrophobically treated by patterning only the region of the painted reflector surface.

30. The reflector of claim 29, wherein the only the region of the reflector surface is patterned by sandblasting only the region of the painted reflector surface.

* * * * *